US009772151B1

(12) United States Patent
Sanderson et al.

(10) Patent No.: US 9,772,151 B1
(45) Date of Patent: Sep. 26, 2017

(54) MAGAZINE EXTENSION

(71) Applicant: Henning's Shop, LLC, Longmont, CO (US)

(72) Inventors: Matt Sanderson, Berthoud, CO (US); Henning Wallgren, Longmont, CO (US)

(73) Assignee: Henning's Shop, LLC, Longmont, CO (US)

( * ) Notice: Subject to any disclaimer, the term of this patent is extended or adjusted under 35 U.S.C. 154(b) by 0 days.

(21) Appl. No.: 15/152,288

(22) Filed: May 11, 2016

(51) Int. Cl.
*F41A 9/65* (2006.01)
*F41A 9/63* (2006.01)

(52) U.S. Cl.
CPC ..... *F41A 9/63* (2013.01)

(58) Field of Classification Search
CPC ..... F41A 9/63; F41A 9/71; F41A 9/65
USPC ..... 42/50, 49.02, 49.01, 6
See application file for complete search history.

(56) References Cited

U.S. PATENT DOCUMENTS 5,642,582 A * 7/1997 Grams ..... F41A 9/65 42/50
5,666,752 A * 9/1997 Grams ..... F41A 9/71 42/49.02
6,557,287 B2 * 5/2003 Wollmann ..... F41A 9/65 42/50
7,509,767 B2 * 3/2009 Bolen ..... F41A 9/61 42/49.01

* cited by examiner

*Primary Examiner* — Reginald Tillman, Jr.
(74) *Attorney, Agent, or Firm* — David S. Kerr; Berg Hill Greenleaf Ruscitti LLP

(57) ABSTRACT

The inventive technology herein describes an improved magazine extension configured to be coupled with an ammunition magazine for a firearm. In one embodiment, the improved magazine extension may include an indexing channel to facilitate a more efficient and accurate indexing of the magazine into the firearm. Additional embodiments may include an improved magazine extension having an increased ammunition capacity, as well as a quick release catch to enable the efficient removal of a magazine from the firearm.

20 Claims, 14 Drawing Sheets

MAGAZINE EXTENSION

TECHNICAL FIELD

Generally, the inventive technology described herein relates to the field of firearm accessories. Specifically, the inventive technology includes a novel improved magazine extension. In one preferred embodiment the improved magazine extension may incorporate improved features that may facilitate a faster and more accurate indexing of a firearm magazine, while in some embodiments increasing the magazine's ammunition capacity.

BACKGROUND OF THE INVENTION

Traditional magazine extensions are often positioned on the terminal ends of firearm magazines to increase ammunition capacity. For example, traditional magazine extensions, such as the base pads described in U.S. Pat. No. 7,509,767, provide a bulky main body which may facilitate gross hand manipulation by a user, as well as provide additional rounds of ammunition. While known in the field, such traditional magazine extensions suffer several limitations. For example, traditional base pads are focused on increasing ammunition capacity, as well as the gross manipulation by a user, or more specifically, providing a larger and bulkier surface area with which a user can grasp the magazine, whether during a loading or re-loading sequence of movements. Such traditional systems fail to account for features that may facilitate, not only gross, but fine hand-motor manipulation, muscle memory, as well as tactile recognition, which all contribute to the consistent indexing of a firearm magazine. Failure to properly index a firearm magazine, especially in high-stress or battlefield conditions encountered by police or military personal, or even lay persons when encountering a self-defense incident, may represent a life-or-death situation where the moments lost due to improper indexing may have serious and permanent consequences.

The current invention overcomes these limitations, and indeed surpasses the functionality of such traditional magazine extensions. It is therefore the object of the present invention to provide a magazine extension having improved features to facilitate the proper indexing of a magazine by a user. For example, the invention may include improved indexing features that may ensure a user, such as military personnel or police officer, often in a moment of high-stress, will be able to quickly and accurately index and load a firearm magazine without requiring visual confirmation of the magazines configuration. Accordingly, the objects of the methods and apparatus described herein address each of the aforementioned problems and goals in a practical manner. Naturally, further objects of the inventive technology will become apparent from the description and drawings below.

SUMMARY OF INVENTION

In one embodiment, the current invention provides for a magazine extension (1) having improved indexing features that may facilitate proper indexing of a magazine (2), during for example, the loading and/or reloading of a magazine into a firearm. In some embodiments, the invention may include a magazine extension (1) that may be sold as an after-market product, and may further be configured to be compatible with known industry, and standard branded products, such as the popular line of Glock® handguns.

DETAILED DESCRIPTION OF THE INVENTION

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
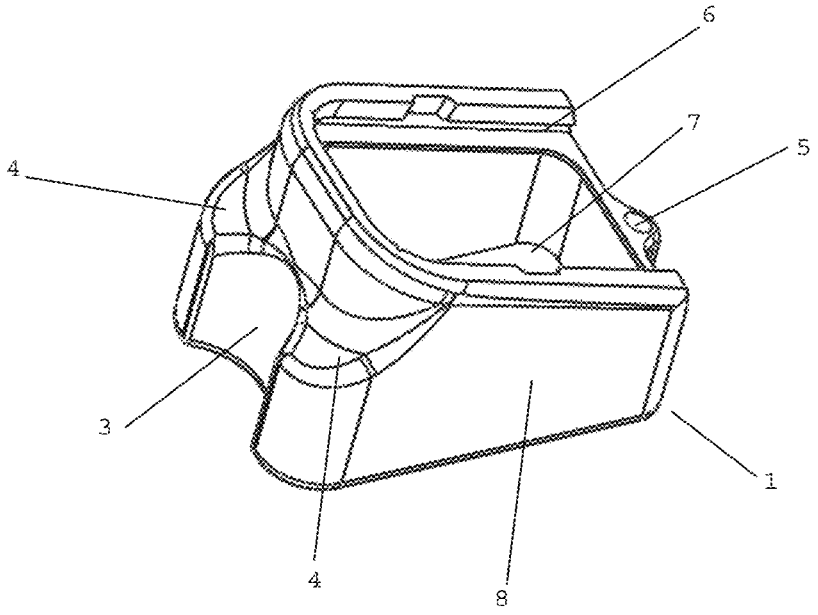
FIG. 1: is a front perspective view of a magazine extension in one embodiment thereof.
Figure 2:
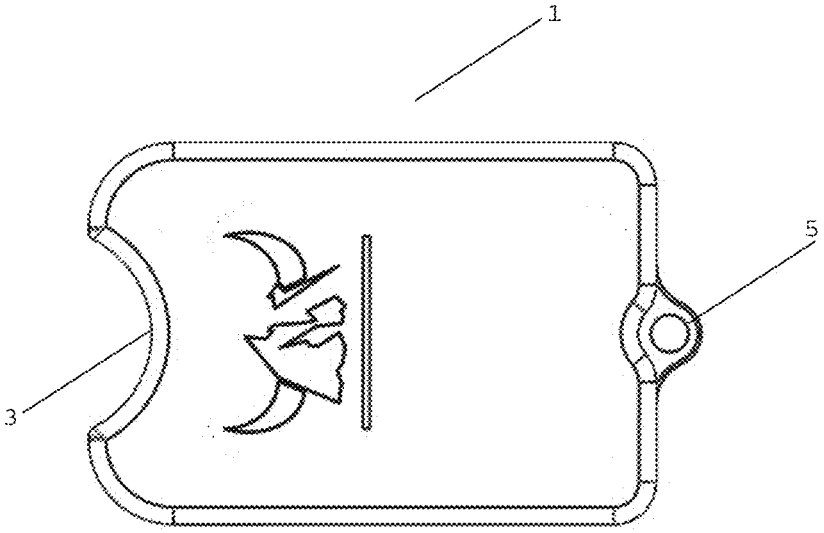
FIG. 2: is a bottom view of a magazine extension in one embodiment thereof.
Figure 3:
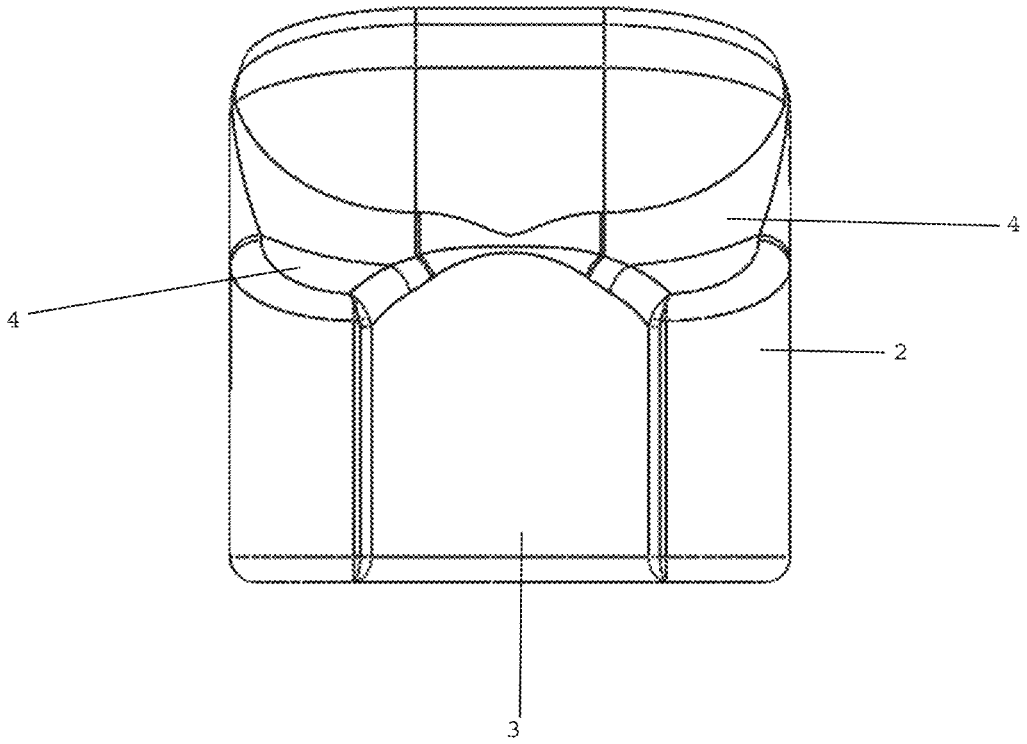
FIG. 3: is a front view of a magazine extension in one embodiment thereof.
Figure 4:
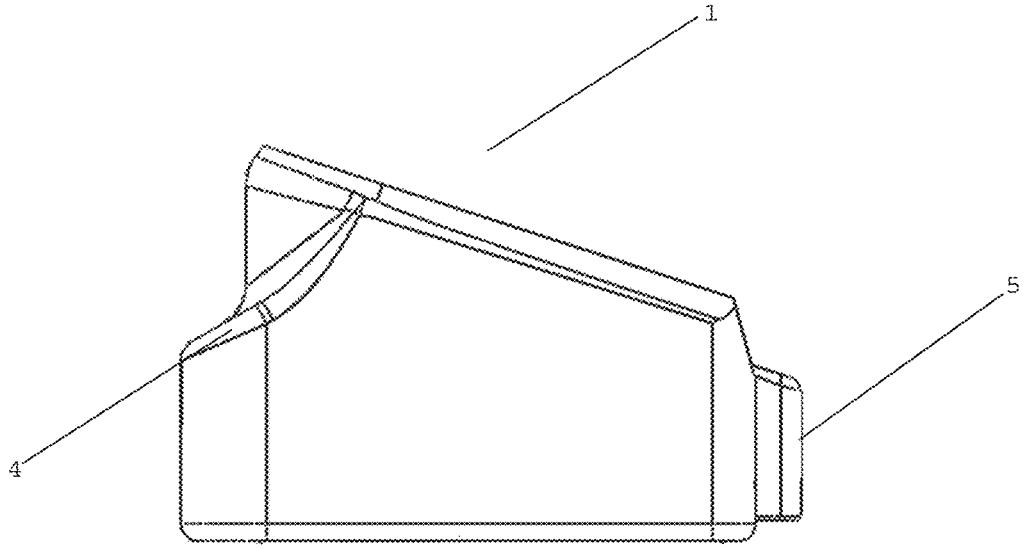
FIG. 4: is a side view of a magazine extension in one embodiment thereof.
Figure 5:
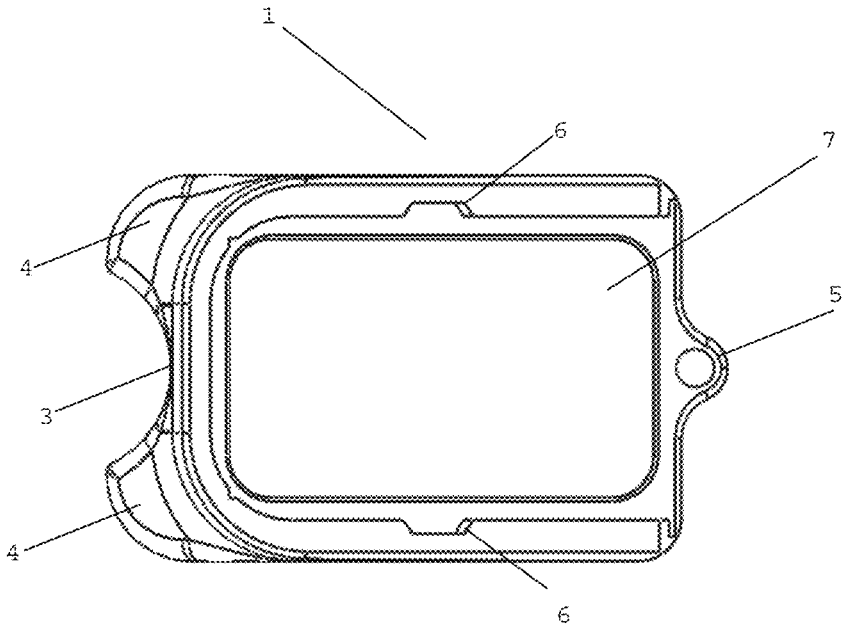
FIG. 5: is a top view of a magazine extension in one embodiment thereof.
Figure 6:
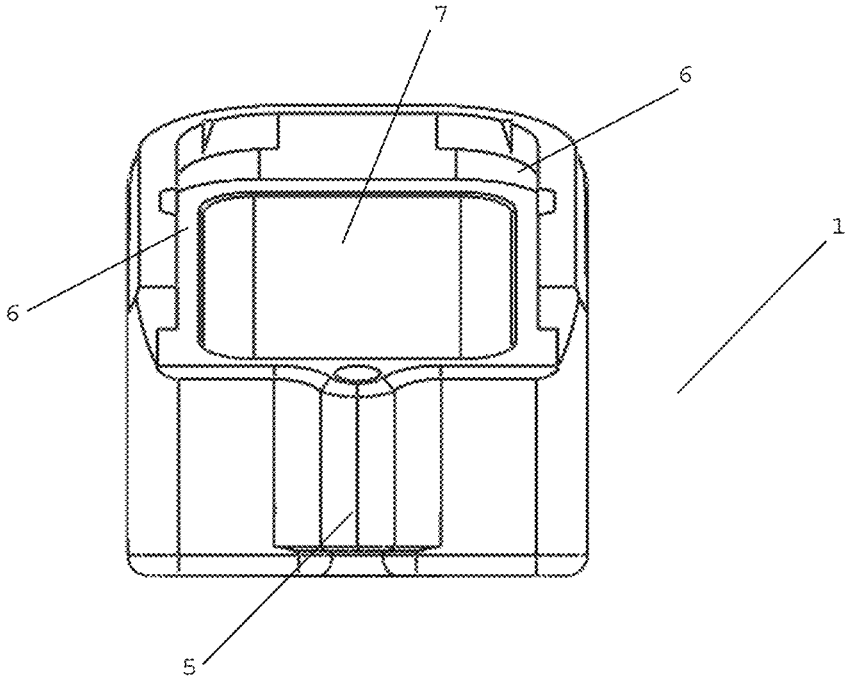
FIG. 6: is a back view of a magazine extension in one embodiment thereof.
Figure 7:
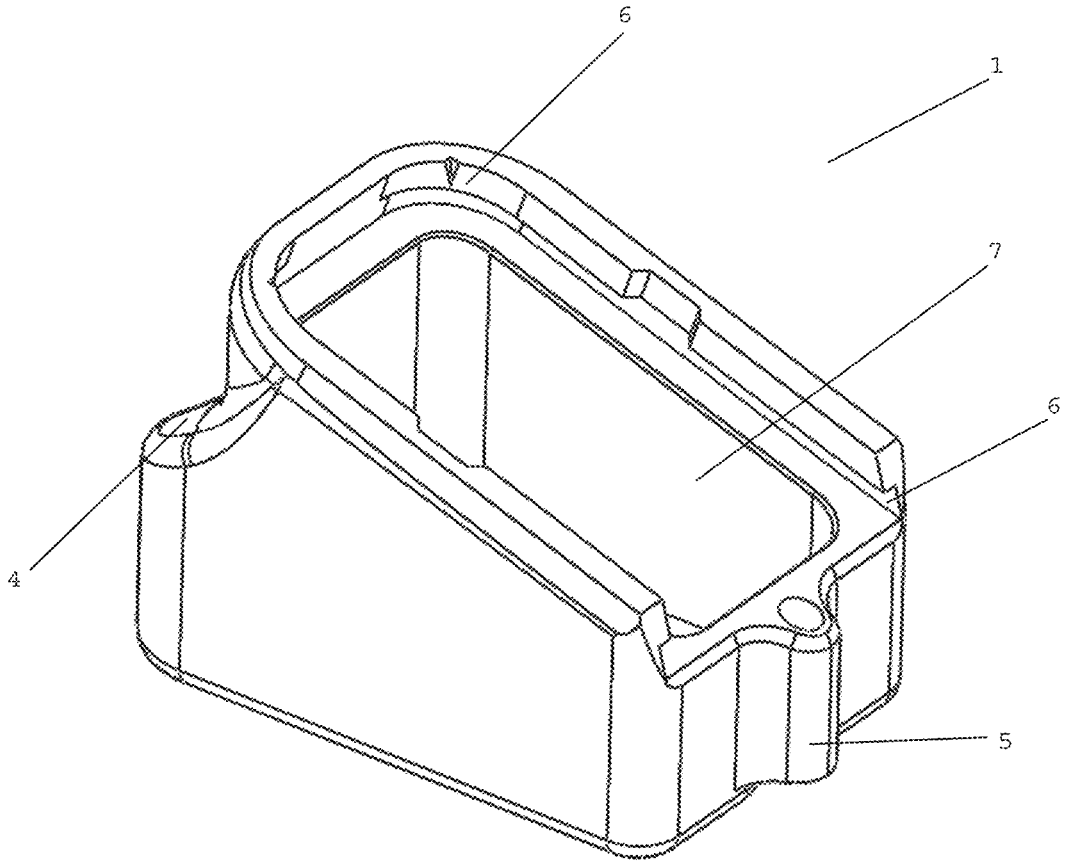
FIG. 7: is a back perspective view of a magazine extension in one embodiment thereof.
Figure 8:
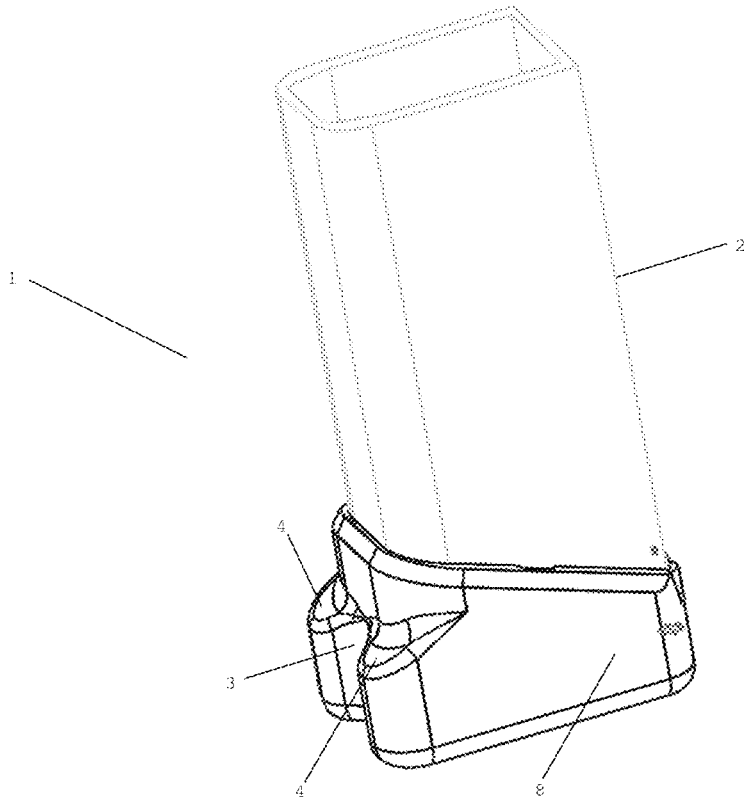
FIG. 8: is a magazine extension coupled with a magazine in one embodiment thereof.
Figure 9:
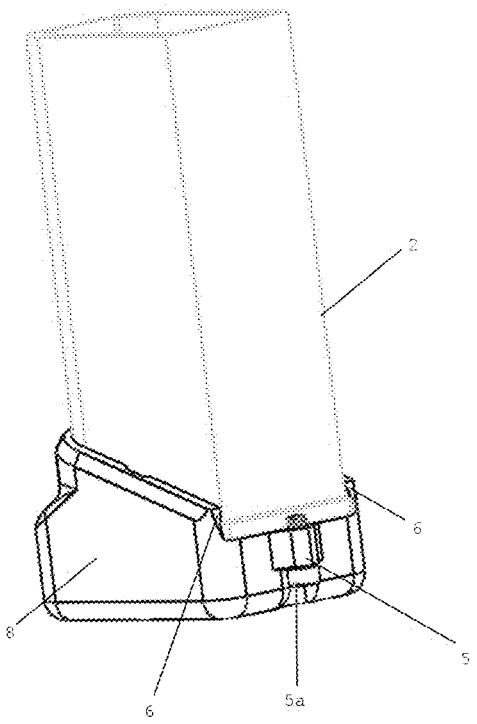
FIG. 9: is a magazine extension coupled with a magazine in one embodiment thereof.
Figure 10:
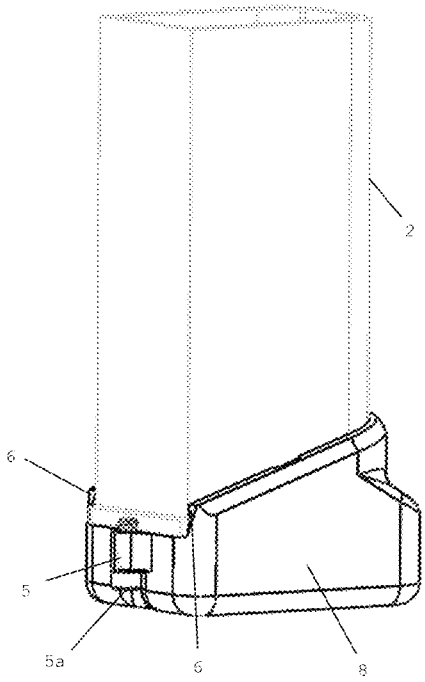
FIG. 10: is a magazine extension coupled with a magazine in one embodiment thereof.
Figure 11:
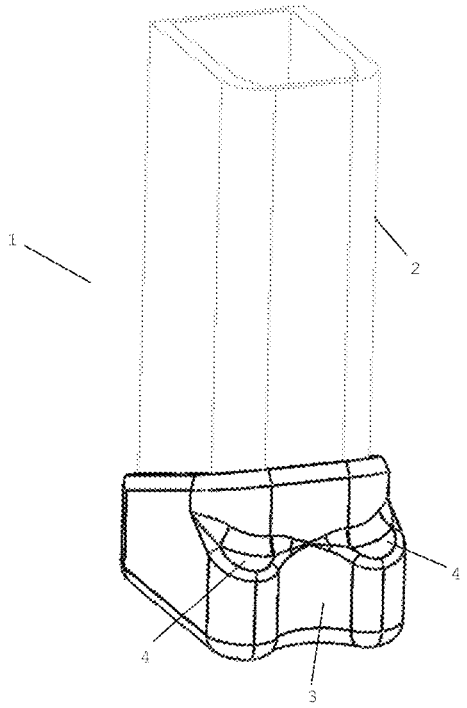
FIG. 11: is a magazine extension coupled with a magazine in one embodiment thereof.
Figure 12:
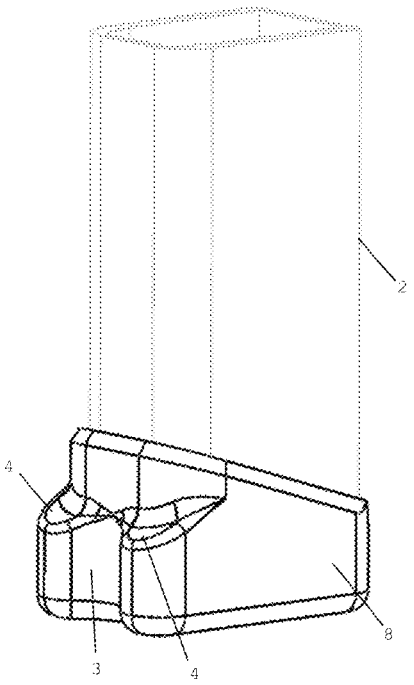
FIG. 12: is a magazine extension coupled with a magazine in one embodiment thereof.
Figure 13:
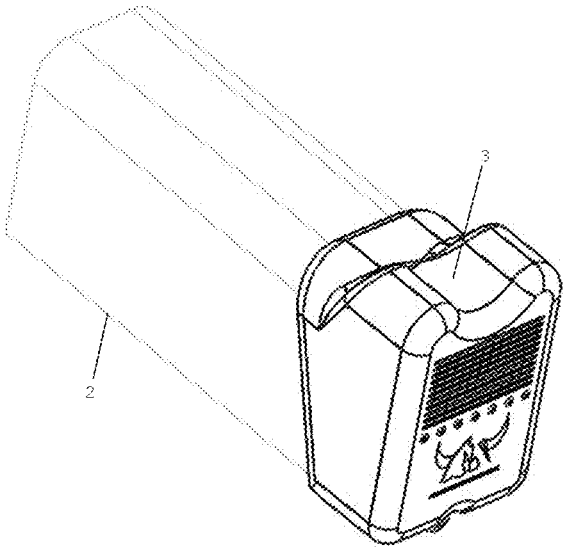
FIG. 13: is a magazine extension coupled with a magazine in one embodiment thereof.
Figure 14:
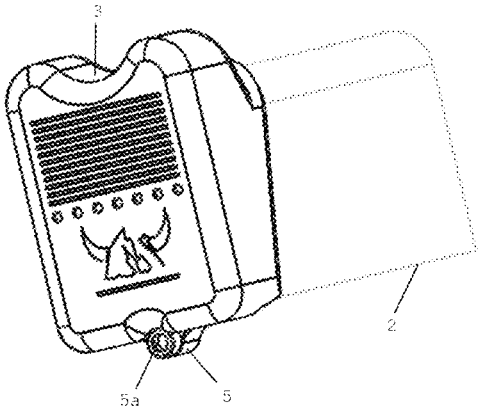
FIG. 14: is a magazine extension coupled with a magazine in one embodiment thereof.

Generally referring to FIG. 1, in one embodiment the inventive technology may include a magazine extension (1) configured to have improved indexing features. In one preferred embodiment, a magazine extension (1) may include one or more magazine couplers (6), which may include any physical configuration, and/or mechanical apparatus that may allow a magazine extension (1) to be coupled to a magazine (2) as generally shown in FIGS. 8-14. In a preferred embodiment shown in the figures, a magazine coupler (6) may include a slot that may be positioned over the terminal edge of a magazine (2). For example, in this embodiment a user may remove the pre-existing magazine factory plate from the terminal end of the magazine. (It should be noted that the internal mechanism(s) used to secure and advance the ammunition upward through the magazine (1) may be positioned within a magazine extension cavity (7) which may be part of the magazine extension body (8), thereby increasing the magazine's (1) total capacity.) Having removed the factory plate—which is typically a polymer based component—the magazine may be coupled with magazine coupler (6), which in this preferred embodiment may include a slide channel configured to receive the terminal end of a magazine. Additional magazine coupler (6) configurations may be contemplated within the scope of this invention, including, but not limited to: a slide magazine coupler, a snap magazine coupler, a fitted magazine coupler; a channel magazine coupler; a quick-release magazine coupler; a twist magazine coupler and the like.

Additionally, in a preferred embodiment, the magazine extension (1) and/or magazine extension body (8) may be formed from a milled aluminum core, however additional materials and combinations may be contemplated, such as, but not limited to: an aluminum magazine extension body; an anodized aluminum magazine extension body; a plastic magazine extension body; a composite magazine extension body; a metal magazine extension body; a metal-plastic hybrid magazine extension body and the like.

Again generally referring to the FIGS. 8-14, in one embodiment a magazine (2), having been coupled with a magazine extension (1), may further be secured by the action of a magazine lock (5). As shown in FIG. 1, in a preferred embodiment, a magazine lock (5) may include a threaded hole that may further accept a threaded screw (5*a*). In this preferred embodiment, a magazine (2) may be secured to the magazine extension by a magazine coupler (6), which in this preferred embodiment may be accomplished by inserting the beveled terminal edge of a magazine (2) into a slide coupler position until the rear surface of the magazine (2) traverses past the magazine lock (5) which may then be engaged to secure the magazine into position.

Again, in this preferred embodiment, the beveled terminal edge of a magazine (2) may be inserted into a slide coupler position until the rear surface of the magazine (2) traverses past the magazine lock (5), at which point a threaded screw (0.5*a*) may be inserted up through a threaded hole until the end of the screw extends out of the hole such that it may interface with the back surface of the magazine (2), thereby preventing the magazine (2) from becoming dislodged from the magazine coupler (6). Additional magazine lock (5) configurations may be contemplated within the scope of this invention, including, but not limited to: a screw lock; a twist lock; a snap lock; a slide lock; a detachable lock; a compression lock; a spring biased lock and the like.

In one embodiment the magazine extension (1) may include improved features that may promote consistent and proper indexing of a magazine, for example during reloading. Referring to FIGS. 1-3 and 5, in one preferred embodiment, the magazine extension (2) may include an indexing channel (3). In this preferred embodiment, the indexing channel (3) may roughly approximate the shape and width of a human finger—preferably the index finger. In this preferred configuration, a user initiating the action of reloading, may grasp a magazine extension (1) having an indexing channel (3). During this movement a user may place their index, or other finger, into the indexing channel (3) forming an improved grip, as well as a physical indication of the proper orientation with respect to quickly and accurately reloading the magazine (2).

For example, in the preferred embodiment shown in the figures, the indexing channel (3) may be integral with the magazine extension body (8), and may further be positioned on the front leading edge of the magazine extension (1). In this configuration, the indexing channel (3) may point in the same direction as the gun barrel, or more generally to the distal end of the firearm. As such, a user grasping the magazine, by placing their index finger in the indexing channel (3) he or she may immediately know, through tactical sensation and muscle memory that the magazine is in the correct orientation to be inserted into the firearm. Conversely, should a user grasp the magazine, and not feel/find the indexing channel (3) may immediately know, through tactical sensation and muscle memory that the magazine is in the incorrect orientation to be inserted into the firearm and may compensate accordingly. Additional embodiments may include a gripping surface (9). In a preferred embodiment, a gripping surface (9) may include a surface with increased friction or tactile indicators that may more easily secure an index finder in the indexing channel (3). In some embodiment this a gripping surface (9) may be integral with the magazine extension (1), or may be later applied, perhaps as a permanent or semi-permanent adhesive or strip.

As discussed above, in high pressure situations, such as those experienced by police, military, competition shooters or even common citizens, the ability to quickly access the orientation of a magazine to be reloaded through tactile sensation and muscle memory may mean the difference between life and death.

Additional embodiments may include quick release catch (4). In a preferred embodiment shown in FIGS. 1, 3-5 and 7, a quick release catch (4) may include a raised surface extending along the front edge of the magazine extension body (8). In this configuration, when the magazine (2) is positioned inside the firearm the quick release catch (4) may extend outward beyond the front leading edge of the magazine (2). This quick release catch (4) may allow a user to efficiently strip the magazine during, for example, reloading using the knife-edge of the user's support hand.

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, techniques as well as devices to accomplish an improved magazine extension and the like. In this application, the methods and apparatus for the aforementioned systems are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both techniques as well as devices to accomplish the appropriate system. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in method-oriented terminology, each element of the claims corresponds to a device. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and/or device." Such changes and alternative terms are to be understood to be explicitly included in the description.

Any patents, publications, or other references mentioned in this application for patent, such as in the specification or an IDS are hereby incorporated herein by reference in their entirety. Any priority case(s) claimed by this application is hereby appended and hereby incorporated herein by reference in their entirety. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated herein by reference in their entirety. Finally, all references listed in the list of References To Be Incorporated By Reference In Accordance With The Patent Application or other information disclosure statement and the like filed with the application are hereby appended and hereby incorporated herein by reference in their entirety, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the methods and/or apparatus for providing an improved magazine extension as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group*, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this application also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The inventive subject matter is to include, but certainly not be limited as, a system substantially as herein described with reference to any one or more of the Figures and Description (including the following: for example, the process according to any claims and further comprising any of the steps as shown in any Figures, separately, in any combination or permutation).

What is claimed is:

1. A magazine extension comprising:

a magazine extension body;

the magazine extension body having a magazine coupler configured to be coupled with the bottom end of a firearm magazine;

at least one magazine lock configured to secure the magazine extension body to said coupled firearm magazine; and at least one vertical indexing channel on said magazine extension body, the vertical indexing channel having a valley configured to be aligned with the longitudinal axis of the firearm magazine and further configured to accommodate a user's index finger when indexing said magazine wherein, the magazine extension body further comprising a projection on each side of the channel, the projections extending the length of the channel.

2. A magazine extension as described in claim 1 wherein said magazine coupler comprises a magazine coupler selected from the group consisting of: a slide magazine coupler, a snap magazine coupler, a fitted magazine coupler; a channel magazine coupler; a quick-release magazine coupler; and a twist magazine coupler.

3. A magazine extension as described in claim 1 wherein said magazine lock comprises a lock selected from the group consisting of: a screw lock; a twist lock; a snap lock; a slide lock; a detachable lock; a compression lock; and a spring biased lock.

4. A magazine extension as described in claim 1 wherein said vertical indexing channel comprises a vertical integral indexing channel.

5. A magazine extension as described in claim 1 and further comprising at least one integral quick release catch.

6. A magazine extension as described in claim 1 and further comprising a magazine extension cavity configured to be capable of containing at least one bullet.

7. A magazine extension as described in claim 1 wherein said vertical indexing channel comprises a gripping surface.

8. An increased magazine extension comprising:

a magazine extension body;

a magazine extension cavity configured to be capable of containing at least one bullet;

a magazine coupler configured to be coupled with the bottom end of a firearm magazine;

at least one magazine lock configured to secure said coupled magazine; and at least one vertical indexing channel on said magazine extension body configured to be in-line with the length of said magazine and further configured to accommodate a user's index finger when indexing said magazine, the vertical indexing channel having a valley configured to be aligned with the longitudinal axis of the firearm magazine wherein said indexing comprises grasping and reloading said magazine when said magazine is in a substantially inverted and outward facing position and wherein said vertical indexing channel is positioned in the same direction as the gun barrel to facilitate rapid tactile recognition of the correct orientation of said magazine during indexing reloading, the magazine extension body further comprising a projection on each side of the channel, the projections extending the length of the channel.

9. An increased magazine extension as described in claim 8 wherein said magazine coupler comprises a magazine coupler selected from the group consisting of: a slide magazine coupler, a snap magazine coupler, a fitted magazine coupler; a channel magazine coupler; a quick-release magazine coupler; and a twist magazine coupler.

10. An increased magazine extension as described in claim 8 wherein said magazine lock comprises a lock selected from the group consisting of: a screw lock; a twist lock; a snap lock; a slide lock; a detachable lock; a compression lock; and a spring biased lock.

11. An increased magazine extension as described in claim 8 wherein said vertical indexing channel comprises an integral vertical indexing channel.

12. An increased magazine extension as described in claim 8 and further comprising at least one integral quick release catch.

13. An increased magazine extension as described in claim 8 wherein said vertical indexing channel comprises a gripping surface.

14. An increased magazine extension as described in claim 8 wherein said magazine extension body comprises a magazine extension body selected from the group consisting of: an aluminum magazine extension body; an anodized aluminum magazine extension body; a plastic magazine extension body; a composite magazine extension body; a metal magazine extension body; a metal-plastic hybrid magazine extension body.

15. A quick release magazine extension comprising:

a magazine extension body;

a magazine extension cavity configured to be capable of containing at least one bullet;

a magazine coupler configured to be coupled with the bottom end of a firearm magazine;

at least one magazine lock configured to secure said coupled magazine;

at least one integral quick release catch; and at least one vertical indexing channel on said magazine extension body configured to be in-line with the length of said magazine and further configured to accommodate a user's index finger when indexing said magazine, the vertical indexing channel having a valley configured to be aligned with the longitudinal axis of the firearm magazine wherein said indexing comprises grasping and reloading said magazine when said magazine is in a substantially inverted and outward facing position and wherein said vertical indexing channel is positioned in the same direction as the gun barrel to facilitate rapid tactile recognition of the correct orientation of said magazine during indexing reloading, the magazine extension body further comprising a projection on each side of the channel, the projections extending the length of the channel.

16. A quick release magazine extension as described in claim 15 wherein said magazine coupler comprises a magazine coupler selected from the group consisting of: a slide magazine coupler, a snap magazine coupler, a fitted magazine coupler; a channel magazine coupler; a quick-release magazine coupler; and a twist magazine coupler.

17. A quick release magazine extension as described in claim 15 wherein said magazine lock comprises a lock selected from the group consisting of: a screw lock; a twist lock; a snap lock; a slide lock; a detachable lock; a compression lock; and a spring biased lock.

18. A quick release magazine extension as described in claim 15 wherein said vertical indexing channel comprises a gripping surface.

19. A quick release magazine extension as described in claim 15 wherein said magazine extension body comprises a magazine extension body selected from the group consisting of: an aluminum magazine extension body; an anodized aluminum magazine extension body; a plastic magazine extension body; a composite magazine extension body; a metal magazine extension body; a metal-plastic hybrid magazine extension body.

20. A quick release magazine extension as described in claim 15 wherein said magazine coupler comprises a magazine coupler configured to be coupled with a Glock® magazine.

* * * * *